US011162254B2

(12) United States Patent
Fujioka

(10) Patent No.: US 11,162,254 B2
(45) Date of Patent: Nov. 2, 2021

(54) METHOD FOR MANUFACTURING COLUMN-BEAM JOINT STRUCTURE AND THE COLUMN-BEAM JOINT STRUCTURE

(71) Applicant: SDR TECHNOLOGY CO., LTD., Tokyo (JP)

(72) Inventor: Toshio Fujioka, Tokyo (JP)

(73) Assignee: SDR TECHNOLOGY CO., LTD., Tokyo (JP)

( * ) Notice: Subject to any disclaimer, the term of this patent is extended or adjusted under 35 U.S.C. 154(b) by 0 days.

(21) Appl. No.: 16/486,166

(22) PCT Filed: Feb. 17, 2017

(86) PCT No.: PCT/JP2017/006017
§ 371 (c)(1),
(2) Date: Aug. 15, 2019

(87) PCT Pub. No.: WO2018/150552
PCT Pub. Date: Aug. 23, 2018

(65) Prior Publication Data
US 2019/0368187 A1 Dec. 5, 2019

(51) Int. Cl.
*E04B 1/24* (2006.01)

(52) U.S. Cl.
CPC ..... *E04B 1/24* (2013.01)

(58) Field of Classification Search
CPC . E04B 1/24; E04B 1/58; E04B 1/2403; E04B 2001/2415; E04C 3/06; E04H 9/021; E04H 9/027; B21B 1/0508; B21B 1/12; B21B 1/22; B21B 1/222; B21B 1/24; B21B 1/38
See application file for complete search history.

(56) References Cited

U.S. PATENT DOCUMENTS

| | | | | |
|---|---|---|---|---|
| 2,201,071 A * | 5/1940 | Baugnee | B23K 31/02 29/897.35 |
| 3,896,653 A * | 7/1975 | Sakai | B21B 37/26 72/200 |
| 5,913,794 A | 6/1999 | Chen | |
| 2005/0055970 A1 * | 3/2005 | Simmons | E04C 3/06 52/837 |

FOREIGN PATENT DOCUMENTS

| | | |
|---|---|---|
| JP | 58-49321 | 11/1983 |
| JP | 63-20161 | 1/1988 |
| JP | 6-288033 A | 10/1994 |
| JP | 10-88737 | 4/1998 |

(Continued)

OTHER PUBLICATIONS

Machine Translation of Fujioka (JP2002088912A). "Beam-column joint structure for steel structure". (Year: 2002).*

(Continued)

*Primary Examiner* — David P Bryant
*Assistant Examiner* — Nirvana Deonauth
(74) *Attorney, Agent, or Firm* — Nixon & Vanderhye P.C.

(57) ABSTRACT

Provided is a column-beam joint structure 1, wherein a plurality of thick-walled portions 3, notches 7, and narrow-width portions 9*a* on a central side of a flange plate 5 are formed integrally, cutting (dividing) is effected at a cut line 8, and the thick-walled portion 3 is welded and joined to a column 2*a*.

3 Claims, 5 Drawing Sheets

(56) References Cited

FOREIGN PATENT DOCUMENTS

| | | |
|---|---|---|
| JP | 10-159176 | 6/1998 |
| JP | 2000-199270 A | 7/2000 |
| JP | 2002-88912 | 3/2002 |
| JP | 2006-2505 | 1/2006 |
| JP | 2009-121031 | 6/2009 |

OTHER PUBLICATIONS

Machine Translation of Aizawa et al. (JP2009121031A). "Building member for residence" (Year: 2009).*
Machine Translation of Osada et al. (JPS5849321B2). "Broadside Rolling method for metallic slab" (Year: 1983).*
International Search Report for PCT/JP2017/006017 dated May 9, 2017, 5 pages.
Written Opinion of the ISA for PCT/JP2017/006017 dated May 9, 2017, 4 pages.
Decision of Refusal dated Sep. 17, 2019 in Japanese Application No. 2016-030517, with English translation, 4 pages.
Notice of Reasons for Refusal dated Feb. 5, 2019 in Japanese Application No. 2016-030517, with English translation, 6 pages.

* cited by examiner

METHOD FOR MANUFACTURING COLUMN-BEAM JOINT STRUCTURE AND THE COLUMN-BEAM JOINT STRUCTURE

This application is the U.S. national phase of International Application No. PCT/JP2017/006017 filed Feb. 17, 2017, the entire contents of which is hereby incorporated by reference.

TECHNICAL FIELD

The present invention relates to a method for manufacturing a column-beam joint structure of steel structure which has a column and a beam and sets a yield point at a portion of the beam apart from a column-beam joint part, and to the column-beam joint structure.

BACKGROUND ART

As a column-beam joint structure to which the so-called RBS (Reduced Beam Section Connections) method for setting a yield point at a position apart from a column-beam joint part is applied, a column-beam joint structure 60 has been proposed in which a flange 65 and notches 67 are formed in a beam 62 distantly from a column-beam joint part 62*b*, as shown in FIG. 15, for example.

PRIOR ART DOCUMENTS

Patent Documents

[Patent Document 1] JP-A-2006-002505
[Patent Document 2] JP-A-2002-088912

SUMMARY OF THE INVENTION

Problems that the Invention is to Solve

In Patent Document 1, a column-beam joint structure 1 is proposed in which notches 7 are provided in a beam flange plate 5, and, in Patent Document 2, a column-beam joint structure is proposed in which notches 7 are formed in a reinforced plate 5 at positions apart from a column 1.

Such a column-beam joint structure is adapted such that, when a large external force is applied due to an earthquake or the like, a ductile fracture or a brittle failure is prevented from occurring at a column-beam joint part owing to the external force.

However, with the column-beam joint structure 1 in Patent Document 1, it is necessary to secure an allowable value by more enlarging the beam width in order to prevent the fracture of the beam flange plate 5 at the column surface. As a result, there arises the need to more enlarge the column width, which makes economical design difficult, so that there is room for further improvement.

In addition, with the column-beam joint structure in Patent Document 2, since a method is adopted in which heating and the like are provided by applying a compressive force in a material axis direction (beam longitudinal direction) of a beam 2, the manufacture becomes complicated, so that there is room for further improvement.

The present invention has been devised in view of the above-described aspects, and its object is to provide a method for manufacturing a column-beam joint structure and the column-beam joint structure which make it possible to reduce the weight of the steel material and are more inexpensive by preventing the enlargement of a column cross section owing to an increase in the bending width of the beam by making it unnecessary to form large notches in the flange plate for the beam. In addition, another object of the invention is to provide an inexpensive method for manufacturing a column-beam joint structure and the column-beam joint structure which ensure the weld strength of an end portion of the beam without needing to greatly enlarge the width of the flange plate and make it unnecessary to enlarge the column cross section, to thereby make it possible to prevent the occurrence of a ductile fracture and a brittle failure at a column-beam joint part due to a seismic force and maintain desired bending resistance of the beam.

Means for Solving the Problems

In accordance with the present invention, there is provided a column-beam joint structure wherein, at a column-beam joint part of a steel structure joining a column and a beam and having at least one first flange plate and at least one second flange plate for the beam, the first flange plate is joined through the joint part to a column surface at one end thereof with a substantially horizontal surface and is joined at another end thereof to the second flange plate opposing the column surface, and wherein the first flange plate and the second flange plate are joined to a web plate for the beam having a substantially vertical surface, and the first flange plate has a notch at a position apart from the column surface and at least one thick-walled portion in a vicinity of the joint part.

According to the column-beam joint structure in accordance with the present invention, since at least a thick-walled portion is provided in the first flange plate where a notch is formed, it is possible to further enlarge the welded joint cross section with respect to the column.

According to the present invention, it becomes possible to make smaller the width of the flange plate at a beam end portion in a widthwise direction of the beam, and it is unnecessary to make the column cross section large, so that economical design is made possible.

The column-beam joint structure in accordance with the present invention may have at least one pair of notches, and the at least one pair of notches are disposed at symmetrical positions in the widthwise direction of the beam.

According to the present invention, it is possible to simultaneously manufacture a plurality of flange plates for a beam having notches and at least one thick-walled portion.

In accordance with the present invention, there is provided a method for manufacturing a flange plate for the beam for a column-beam joint structure, comprising: a first step of forming in a steel plate for a beam a thick-walled portion and a thin-walled portion in a portion in a material axis direction of the steel plate excluding the thick-walled portion by rolling; a second step of forming a notch in the thin-walled portion apart from the thick-walled portion by rolling; and a third step of forming a narrow-width portion in the thin-walled portion by rolling.

According to the method for manufacturing a flange plate for a column-beam joint structure in accordance with the present invention, it is possible to efficiently manufacture thick-walled portions at beam end portions, notches, and narrow-width portions by rolling.

Accordance with the present invention, there is provided a method for manufacturing an H-shaped steel for a column-beam joint structure, which is a method for manufacturing an H-shaped steel for a beam in a column-beam joint structure constituted by a flange plate and a web plate, the H-shaped steel constituted by a thick plate being formed by the method comprising: a first step of forming in the flange plate of the H-shaped steel a thick-walled portion and a thin-walled portion in a portion in a material axis direction of the beam excluding the thick-walled portion by rolling; a second step of forming a notch in the thin-walled portion apart from the thick-walled portion by rolling; and a third step of forming a narrow-width portion in the thin-walled portion by rolling.

According to the present invention, it is possible to efficiently manufacture thick-walled portions at beam end portions, notches, and narrow-width portions by rolling.

Advantages of the Invention

According to the present invention, it is possible to ensure the weld strength of the beam end portion without enlarging the width of the flange plate. Consequently, since it is unnecessary to enlarge the width of the column, it becomes possible to suppress the weight of the steel material of the column, thereby making it possible to provide a method for manufacturing a column-beam joint structure and the column-beam joint structure which are inexpensive.

MODE FOR CARRYING OUT THE INVENTION

Figure 1:
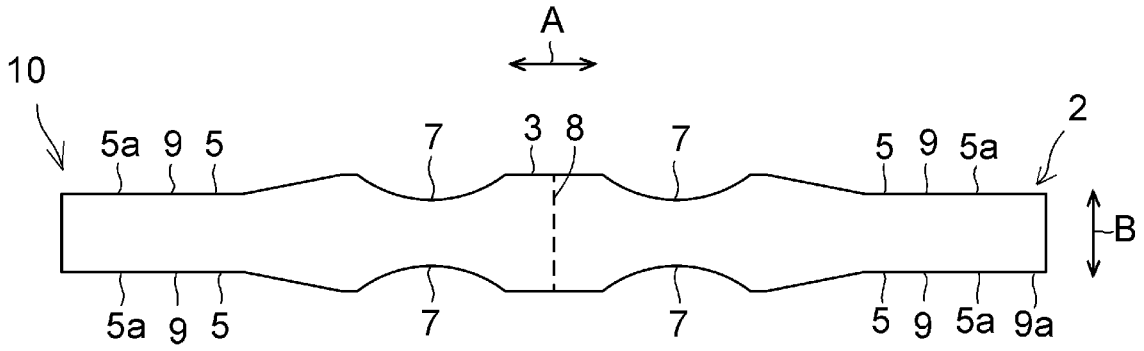
FIG. 1 is an explanatory plan view of a preferred embodiment of a flange plate for a beam in a column-beam joint structure of the invention (First Embodiment)
Figure 2:
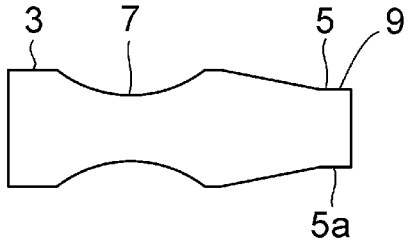
FIG. 2 is a partial explanatory view of FIG. 1 (First Embodiment)

Next, a more detailed description will be given of the mode for carrying out the invention on the basis of preferred embodiments illustrated in the drawings. It should be noted that the present invention is not limited to these embodiments.

First Embodiment

In FIGS. 1 to 6, a column-beam joint structure 1 includes a column 2*a* and a beam 2 joined to the column 2*a*. One end 51 of a flange plate 5 has a substantially horizontal surface and is joined to a column surface of the column 2*a* by welding at a column-beam joint part 2*b*. A thick-walled portion (bulged portion) 3 is present at this welded portion. A web plate 4 of the beam 2 is joined to the column 2*a* by welding. The beam 2 is a built-up H-shaped beam assembled by welding. The other end 52 of the flange plate 5 is butt-welded to a flange plate 5*a* at a central portion in a material axial direction A (longitudinal direction of the beam 2) of the beam 2 by a weld zone 6. The flange plate 5 and the flange plate 5*a* at the central portion are joined to the web plate 4 by welding 6*a* to form the built-up H-shaped beam. Preferably, the flange plate 5, the flange plate 5*a* at the central portion, and the web plate 4 are joined in the form of the beam 2 by welding at a factory and is joined to the column 2*a* at the time of steel frame erection.

In the column-beam joint structure 1, although the web plate 4 of the beam 2 is welded and joined to the column 2*a*, the web plate 4 of the beam 2 may alternatively be joined to the column 2*a* through a gusset plate and bolts (not shown).

When an external force generated in the beam 2 is applied to the column-beam joint structure 1 at the time of an earthquake, bending stress occurring in the beam 2 is large at the column-beam joint part 2*b* and becomes gradually smaller with an increasing distance from the column-beam joint part 2*b*. Larger bending stress is applied to the column-beam joint part 2*b* than at a position distant from the column-beam joint part 2*b*. However, with the column-beam joint structure 1, since the one end 51 of the flange plate 5 is reinforced at the column-beam joint part 2*b* by the thick-walled portion (bulged portion) 3 which is formed to be wider than the width of the other end 52 of the flange plate 5 in a widthwise direction of the beam 2 and to be thicker than the thickness of the other end 52 of the flange plate 5 in a vertical direction V, and a notch 7 is formed in the flange plate 5 at a position apart from the column 2*a*, even if a large external force which is of such a measure that a ductile fracture or a brittle failure can occur is applied to the column-beam joint part 2*b*, plastic deformation is made to occur at the notch 7 so as to form a yield hinge before a ductile fracture or a brittle failure occurs at the column-beam joint part 2*b*.

Since the flange plate 5 is formed from a steel plate by roll forming in a state in which the notches 7 are provided thereon, it is unnecessary to provide reinforcing plates or the like on the flange plate 5 by welding or the like. In addition, reduction of the amount of steel can be achieved by using a steel plate of a high strength material as the flange plate 5 corresponding to the beam end portion where the stress is large and by using a steel plate of an ordinary material as the flange plate 5*a* corresponding to the central portion of the beam 2*a* where the stress is small. Furthermore, the degree of freedom in design is enlarged since it is possible to freely change the amount of notch on the flange plate 5 constituting the notch 7, the enlarged width of the flange plate 5 at the column-beam joint part 2*b*, and the thickness of the flange plate 5.

Figure 3:
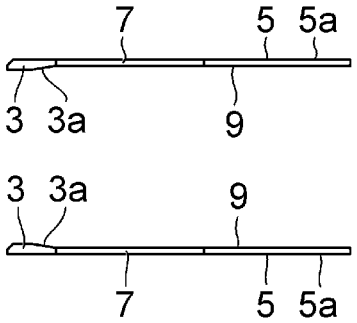
FIG. 3 is an explanatory view illustrating an embodiment of upper and lower flange plates in the invention (First Embodiment)
Figure 4:
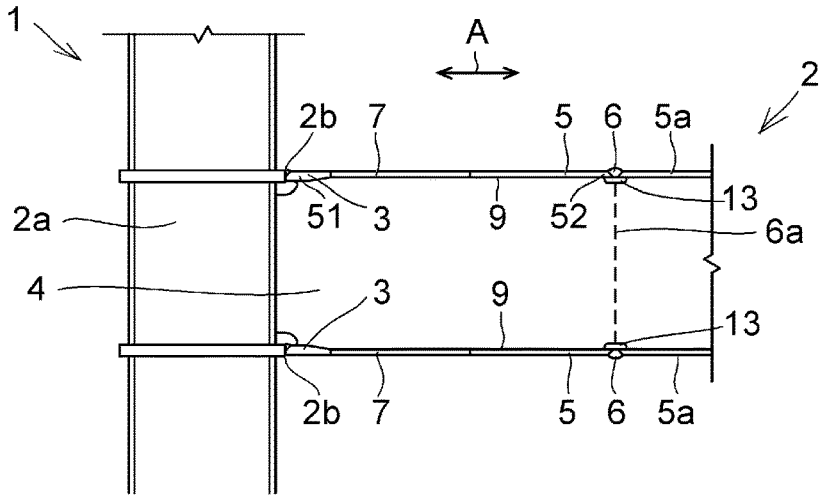
FIG. 4 is an explanatory view of a beam illustrating an embodiment of the column-beam joint structure of the invention (First Embodiment)
Figure 5:
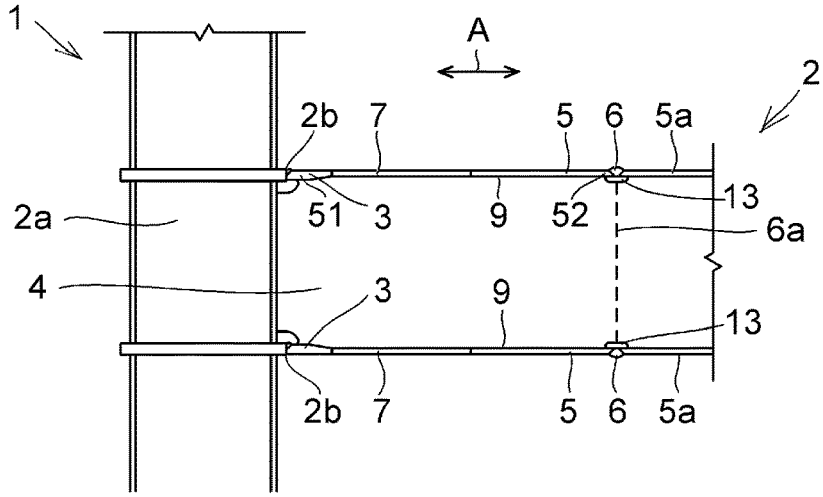
FIG. 5 is an explanatory plan view of the beam illustrating an embodiment of the column-beam joint structure of the invention (First Embodiment)
Figure 6:
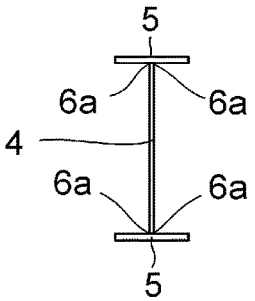
FIG. 6 is a vertical cross-sectional view of the beam illustrating another embodiment of the column-beam joint structure of the invention (First Embodiment)

The followings are formed in a steel plate 10 for the column-beam joint structure: the thick-walled portion (bulged portion) 3 provided in the central portion in the material axis direction A; a pair of thin-walled portions 9 respectively provided on both sides in the material axis direction A of the thick-walled portion 3; the two pairs of notches 7 each pair of which are provided on the respective thin-walled portion 9; and a narrow-width portion 9*a* provided on each thin-walled portion 9 and formed to be narrow in a widthwise direction B of the beam 2, and the pair of flange plates 5 and 5*a* are formed integrally. A plurality of pairs of flange plates 5 and 5*a* are formed integrally and are cut off at a cut line 8, to thereby form the flange plate 5 shown in FIG. 2. FIG. 3 is an explanatory view of a pair of flange plates 5. The flange plate 5 is formed such that the outer cross-sectional size of the H-shaped steel becomes identical, and the thick-walled portion (bulged portion) 3 is formed in such a manner as to project from one surface of the flange plate 5 so as to jut out (bulge) toward the web plate 4 side.

Figure 7:
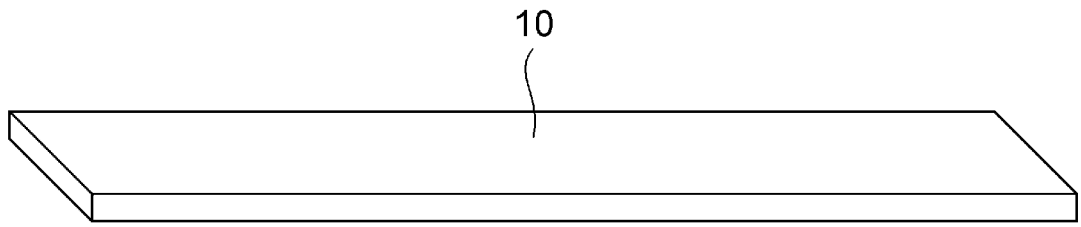
FIG. 7 is an explanatory view illustrating an initial shape in a first step in the process of manufacturing the flange plate for a beam in accordance with the invention (First Embodiment)
Figure 8:
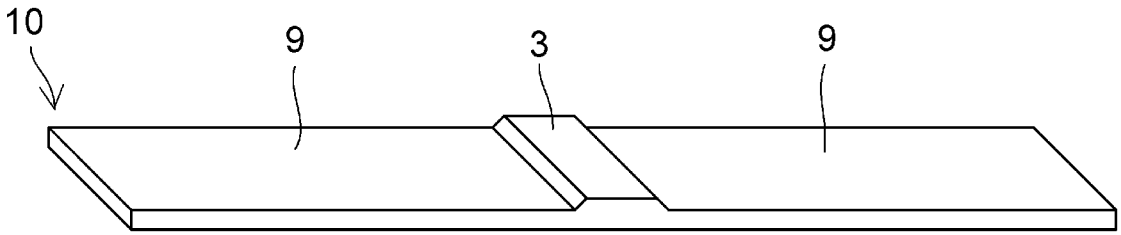
FIG. 8 is an explanatory view illustrating a thick-walled portion and thin-walled portions in a second step in the process of manufacturing the flange plate in accordance with the invention (First Embodiment)
Figure 9:
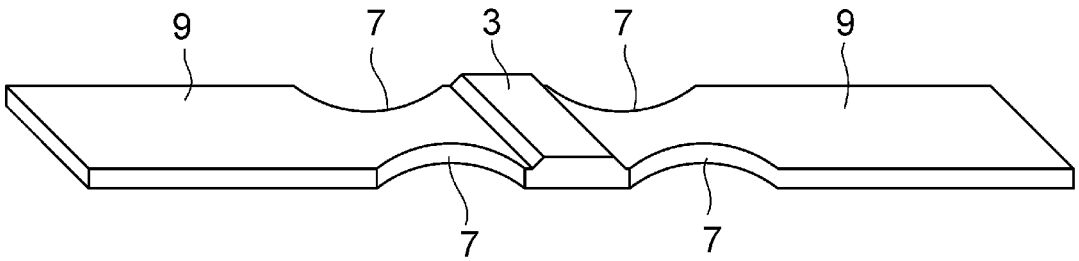
FIG. 9 is an explanatory view illustrating a state in which notches have been formed in a third step in the process of manufacturing the flange plate in accordance with the invention (First Embodiment)
Figure 10:
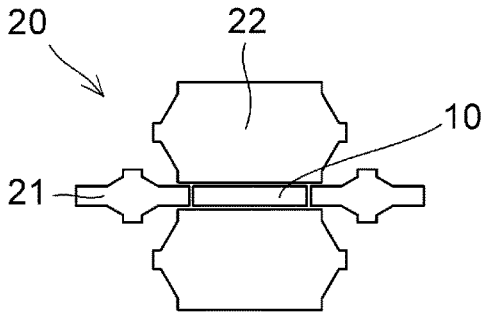
FIG. 10 is a view illustrating a rolling machine for rolling the flange plate in accordance with the invention (First Embodiment)
Figure 11:
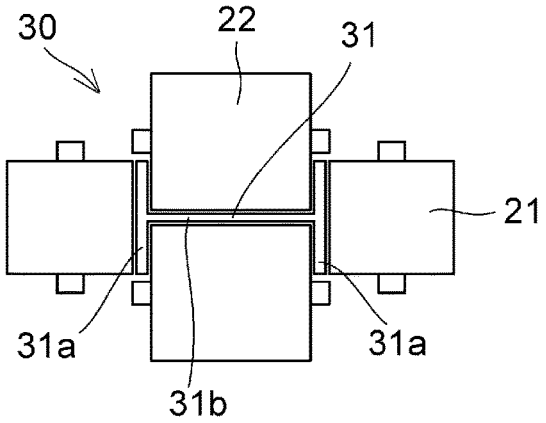
FIG. 11 is a view illustrating a rolling machine for rolling an H-shaped steel for a beam in accordance with the invention (Second Embodiment)

As shown in FIGS. 7 to 10, the steel plate 10 (elongated body) is sequentially formed by a flat steel rolling machine 20. FIG. 7 shows the steel plate 10 in the state before processing. FIG. 8 shows the steel plate 10 in a state in which the thick-walled portion (bulged portion) 3 and the thin-walled portions 9 at portions excluding the thick-walled portion 3 have been formed. FIG. 9 shows the steel plate in a state in which the notches 7 are further formed by vertical rolls 21. After this, the narrow-width portions 9*a* of the flange plate 5 are formed, and the state shown in FIG. 1 is obtained. It should be noted that the notches 7 and the narrow-width portions 9*a* may be formed simultaneously by making the vertical rolls 21 horizontally movable.

The thick-walled portions 3, the notches 7, and the narrow-width portions 9*a* of the thin-walled portions 9 may be formed gradually by repeatedly performing rolling by the vertical rolls 21. Alternatively, however, the notches 7 and the narrow-width portions 9*a* of the thin-walled portions 9 may be formed by cutting, grinding, shaving, gas cutting processing, and the like.

Second Embodiment

Figure 12:
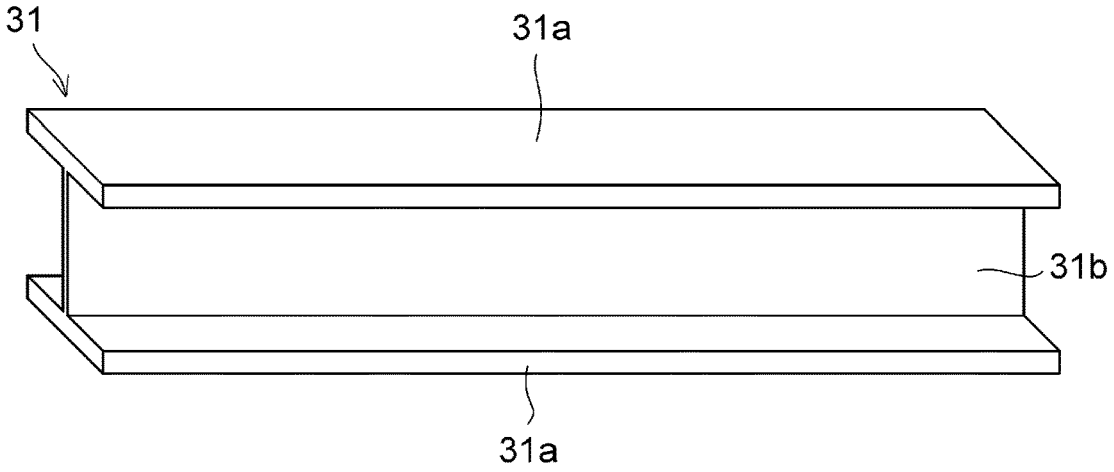
FIG. 12 is an explanatory view illustrating an initial shape in a first step in the process of manufacturing an H-shaped steel in accordance with the invention (Second Embodiment)
Figure 13:
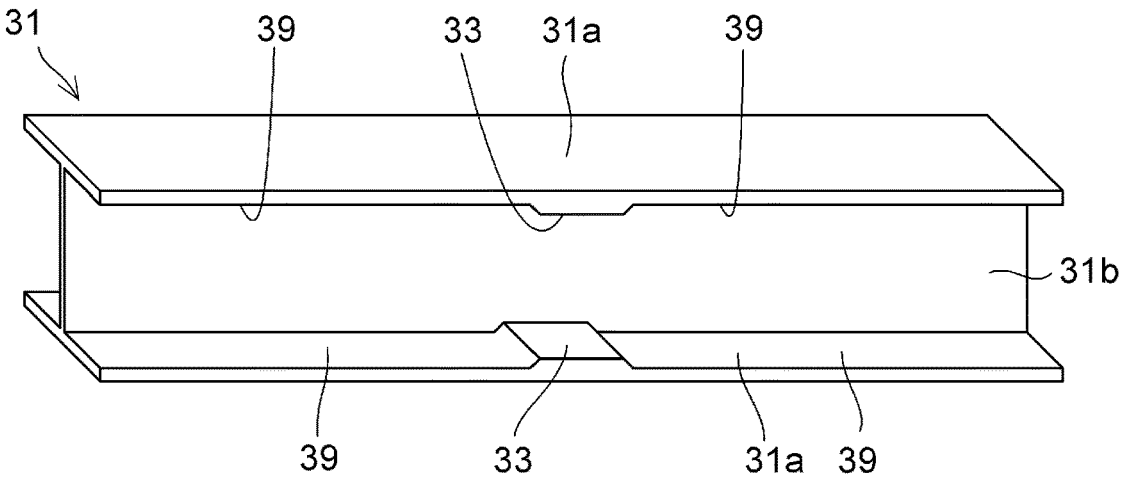
FIG. 13 is an explanatory view illustrating thick-walled portions and thin-walled portions in a second step in the process of manufacturing an H-shaped steel beam structure in accordance with the invention (Second Embodiment)

FIGS. 11 to 14 show a method of manufacturing a rolling formed H-shaped steel 31 for the column-beam joint structure. The thick-plate H-shaped steel 31 constituted by flange plate portions 31*a* and a web plate portion 31*b* is manufactured by an H-shaped steel rolling machine 30 after undergoing a process similar to that shown in FIGS. 7 to 10. The thick-plate H-shaped steel 31 shown in FIG. 12 is rolled into flange thick-walled portions (flange bulged portions) 33 and flange thin-walled portions 39, as shown in FIG. 13. Subsequently, notches 37 and narrow-width portions 39*a* are formed in the same way as the first embodiment. The beam 2 is manufactured by continuously processing a plurality of parts and is cut at cut lines 38.

Figure 14:
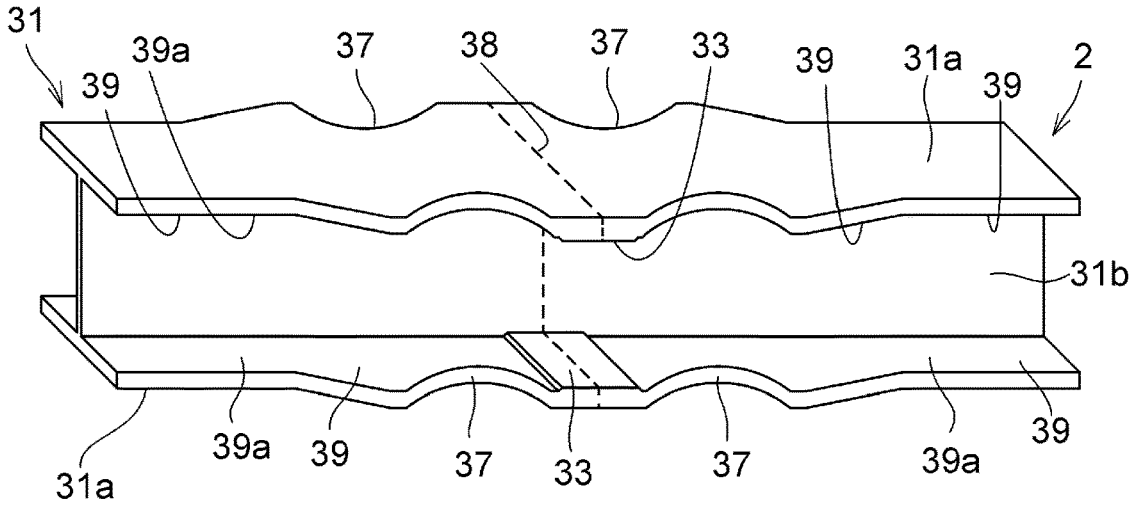
FIG. 14 is an explanatory view illustrating a state in which notches have been formed in a third step in the process of manufacturing an H-shaped steel beam structure in accordance with the invention (Second Embodiment)
Figure 15:
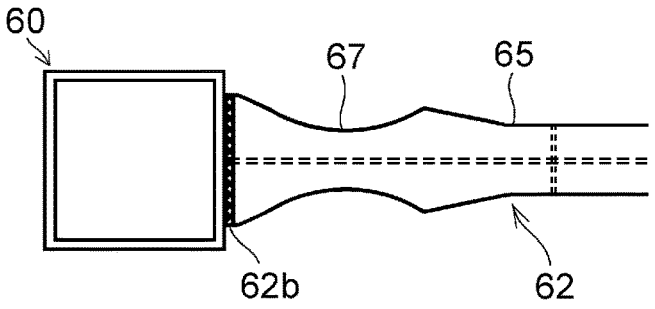
FIG. 15 is an explanatory cross-sectional plan view of an example of a conventional column-beam joint structure.

In the H-shaped steel 31 shown in FIG. 14, the flange thick-walled portions 33, the notches 37, and the narrow-width portions 39*a* of the flange thin-walled portions 39 may be formed gradually by repeatedly performing rolling. Alternatively, however, the notches 37 and the narrow-width portions 39*a* of the flange thin-walled portions 39 may be formed by cutting, grinding, shaving, gas cutting processing, and the like.

According to the present invention, the column-beam joint parts 2*b* can be more uniformly and efficiently in the same way as the first embodiment. In addition, since the flange thick-walled portion (flange bulged portion) 33 is present at one end portion of the flange plate portion 31*a*, it is possible to obtain high weld joint strength without enlarging the width of the flange plate portion 31*a*.

The flange plates 5 and 5*a* and the H-shaped steel 31 in accordance with the present invention may be formed not only by roll forming but by forging. In a case where forming is to be performed by using the flange plates 5 and 5*a* and the flange plate portions 31*a* whose outer surfaces are constant, the flange plates 5 and 5*a* and the flange plate portions 31*a* are appropriately formed by being pressurized from one side thereof.

DESCRIPTION OF REFERENCE NUMERALS

1: column-beam joint structure
2: beam
2*a*: column
2*b*: column-beam joint part
3: thick-walled portion (bulged portion)
4: web plate
5: flange plate
7: notch
9: thin-walled portion
9*a*: narrow-width portion
10: steel plate
20: flat steel rolling machine
21: vertical roll
22: horizontal roll
30: H-shaped steel rolling machine
31: H-shaped steel
31*a*: flange plate portion
31*b*: web plate portion

The invention claimed is:

1. A method for manufacturing a flange plate for a column-beam joint structure comprising:

providing a steel plate for a beam, the steel plate having a longitudinal axis, the steel plate having a length measured in a length direction along the longitudinal axis, a thickness measured in a thickness direction transverse to the length direction, and a width measured in a width direction that is transverse to the thickness direction and the length direction;

forming in the steel plate a first wall portion that has a first thickness measured in the thickness direction and a pair of second wall portions, each spaced along the length direction relative to the first wall portion, each said second wall portion having a second thickness, the first thickness being relatively greater than each said second thickness, each second wall portion being formed to have the relatively smaller second thickness by rolling the steel plate in the length direction using one or more rollers that rotate about a horizontal roller axis, but excluding rolling of the first wall portion, the first wall portion being centrally located along the steel plate between the pair of second wall portions;

forming a pair of notches in said relatively smaller second thickness of each of said pair of second wall portions apart from the relatively thicker first wall portion by rolling using one or more rollers that rotate about a vertical roller axis; and forming each said second wall portion to have a portion extending adjacent to each said pair of notches towards a free end of each of said second wall portions, each free end of said second wall portions having a second width in the width direction that is less than a first width in the width direction of the first wall portion, by rolling using the one or more rollers that rotate about the vertical roller axis.

2. The method for manufacturing a flange plate according to claim 1, wherein each said rolling is performed repeatedly to sequentially form the first wall portion with the relatively greater first thickness, each said pair of notches, and each said second wall portion with the relatively smaller second width.

3. The method for manufacturing a flange plate according to claim 1, wherein the pair of notches in each pair of second wall portions comprises two notches formed in the relatively smaller second width of a respective one of said pair of second wall portions apart from the relatively greater first thickness of the first wall portion by cutting, and, the relatively smaller second width of each said second wall portion is formed by cutting.

* * * * *